US009867399B1

(12) United States Patent
Liu

(10) Patent No.: US 9,867,399 B1
(45) Date of Patent: Jan. 16, 2018

(54) ELECTRONIC CIGARETTE

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 0 days.

(21) Appl. No.: 15/404,161

(22) Filed: Jan. 11, 2017

(30) Foreign Application Priority Data

Aug. 3, 2016 (CN) ..... 2016 1 0627692
Aug. 3, 2016 (CN) ..... 2016 2 0832656 U

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS 9,345,269 B2 * 5/2016 Liu ..... A24F 47/008
9,661,878 B2 * 5/2017 Liu ..... A24F 47/008
2016/0044961 A1 * 2/2016 Liu ..... A24F 47/008 131/329
2016/0183592 A1 * 6/2016 Liu ..... H05B 1/0244 131/329
2017/0042228 A1 * 2/2017 Liu ..... A24F 47/008

* cited by examiner

*Primary Examiner* — Tho D Ta
(74) *Attorney, Agent, or Firm* — Matthias Scholl, PC; Matthias Scholl

(57) ABSTRACT

An electronic cigarette, including an atomizer assembly, including: an upper cover; a shell having two through holes; a base having two blind holes; a heating wire having a limit cover and a support base; two silicon plugs; an upper sealing ring; a lower sealing ring; and a sealing plug. The shell is disposed between the upper cover and the base. Flavored liquid is filled in the shell, and the two silicon plugs are disposed in the two through holes of the shell and seal the two blind holes of the base, respectively. The two silicon plugs each include a breakable neck adapted to be manually broken so that the flavored liquid comes into contact with the heating wire. The upper sealing ring is disposed between the upper cover and the shell, and the lower sealing ring is disposed between the shell and the limit cover of the heating wire.

9 Claims, 5 Drawing Sheets

ELECTRONIC CIGARETTE

CROSS-REFERENCE TO RELATED APPLICATIONS

Pursuant to 35 U.S.C. §119 and the Paris Convention Treaty, this application claims the benefit of Chinese Patent Application No. 201610627692.1 filed Aug. 3, 2016, and to Chinese Patent Application No. 201620832656.4 filed Aug. 3, 2016. The contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

The invention relates to an electronic cigarette.

Description of the Related Art

An electronic cigarette (e-cigarette) is a handheld electronic device that uses an atomizer to vaporize a flavored liquid. Conventionally, even when the e-cigarette is not in use, the flavored liquid is in direct contact with the atomizing core of the atomizer, which tends to adversely affect the properties of the atomizing core.

SUMMARY OF THE INVENTION

In view of the above-described problems, it is one objective of the invention to provide an improved electronic cigarette in which the flavored liquid remains separated from the atomizing core when the e-cigarette is not in use.

To achieve the above objective, in accordance with one embodiment of the invention, there is provided an electronic cigarette, comprising an atomizer assembly, the atomizer assembly comprising: an upper cover; a shell comprising two through holes; a base comprising two blind holes; a heating wire comprising a limit cover and a support base; two silicon plugs; an upper sealing ring; a lower sealing ring; and a sealing plug. The shell is disposed between the upper cover and the base; flavored liquid is filled in the shell, and the two silicon plugs are disposed in the two through holes of the shell and seal the two blind holes of the base, respectively; the two silicon plugs each comprise a breakable neck adapted to be manually broken so that the flavored liquid comes into contact with the heating wire; the upper sealing ring is disposed between the upper cover and the shell, and the lower sealing ring is disposed between the shell and the limit cover of the heating wire; the heating wire is vertically disposed on the support base; and the upper cover is welded on the shell; the sealing plug is disposed on the upper cover; the sealing plug is adapted to seal the flavored liquid in the shell.

In a class of this embodiment, the heating wire is sheathed in a first piece of cotton; an insulating ring and a connector are mounted on the support base; and the limit cover of the heating wire is disposed on the support base.

In a class of this embodiment, the atomizer assembly further comprises a second sealing ring; the second sealing ring is disposed on the base; the base is fixedly connected to the shell.

In a class of this embodiment, the electronic cigarette further comprises a battery assembly; the atomizer assembly is disposed at one side in the battery assembly, and the atomizer assembly is fastened in the battery assembly.

In a class of this embodiment, the electronic cigarette further comprises a battery assembly comprising a plurality of magnets, a housing, and a main carrier; the magnets are embedded in slots on the shell and on the main carrier.

In a class of this embodiment, a first spring is disposed on a first fixing base; an atomizer cover is fastened by a first tightening ring; the atomizer cover is disposed on a main carrier and is fastened by a second tightening ring; and a mouthpiece is disposed on the main carrier.

In a class of this embodiment, a first spring is disposed on a first fixing base; an atomizer cover is fastened by a first tightening ring; the atomizer cover is disposed on the main carrier and is fastened by a second tightening ring; and a mouthpiece is disposed on the main carrier.

In a class of this embodiment, a positive lead on a PCB board is soldered to an anode on a battery cell, and a negative lead on the PCB board is soldered to a cathode on the battery cell; a first piece of ethylene-vinyl acetate copolymer (EVA) cotton is attached to a battery cell; and a second piece of EVA cotton and a third piece of EVA cotton are attached to the anode and the cathode on two sides of the battery cell, respectively.

In a class of this embodiment, the PCB board is fixed on the main carrier via a first screw; the negative lead is soldered on a second fixing base, and the positive lead is soldered on a positive electrode; the second fixing base is integrated with the positive electrode, a second spring, and an insulating sheet, and is fixed on the main carrier via a second screw; the positive lead and the negative lead are soldered on two ends of the PCB board, respectively; a fourth piece of EVA cotton is attached to a first button and a second button; the first button and the second button are mounted on a panel; the panel is embedded and fixed in the main carrier via third screws on two sides of the panel.

Advantage of the electronic cigarette according to embodiments of the invention is that the flavored liquid in the electronic cigarette is sealed from the atomizing core, which is favorable to the protection of the atomizing core.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing an electronic cigarette are described below. It should be noted that the following examples are intended to describe and not to limit the invention.

Figure 1:
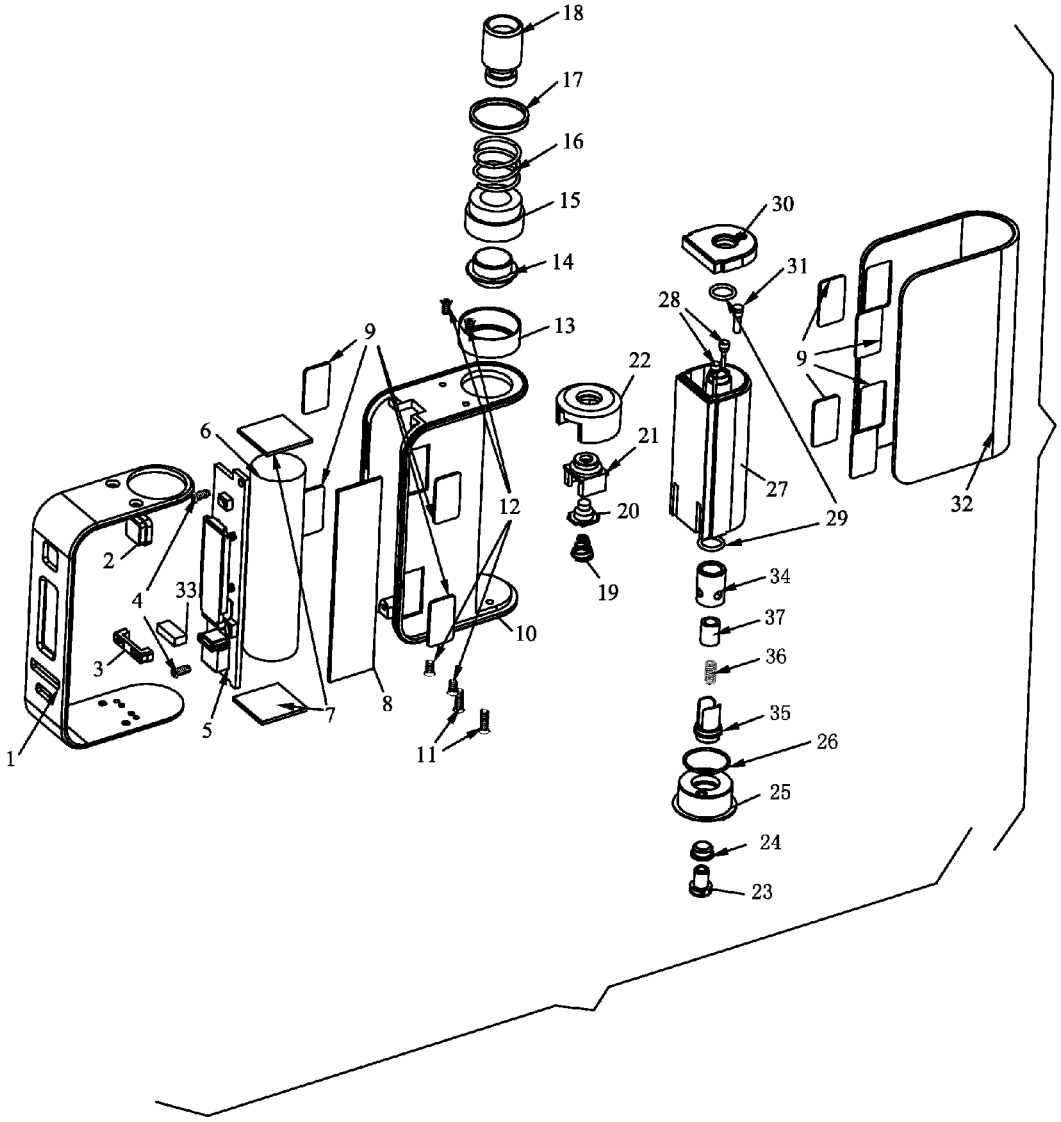
FIG. 1 is an exploded view of an electronic cigarette in accordance with one embodiment of the invention.
Figure 2A:
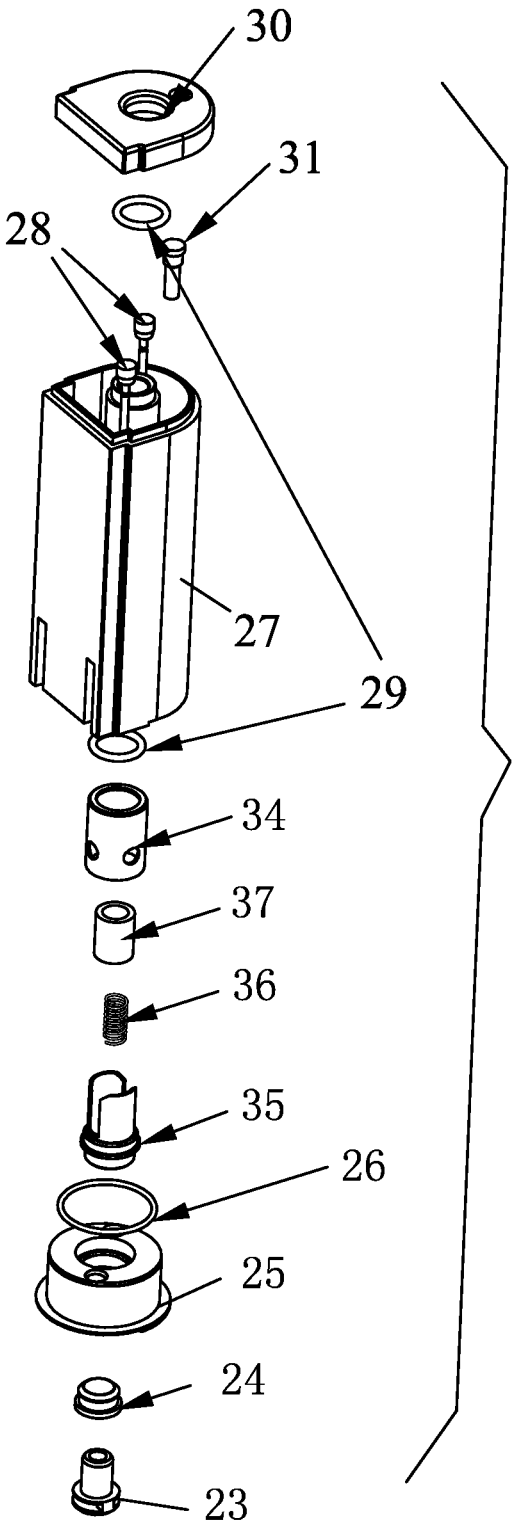
FIG. 2A is an exploded view of an atomizer assembly of an electronic cigarette in accordance with one embodiment of the invention.
Figure 2B:
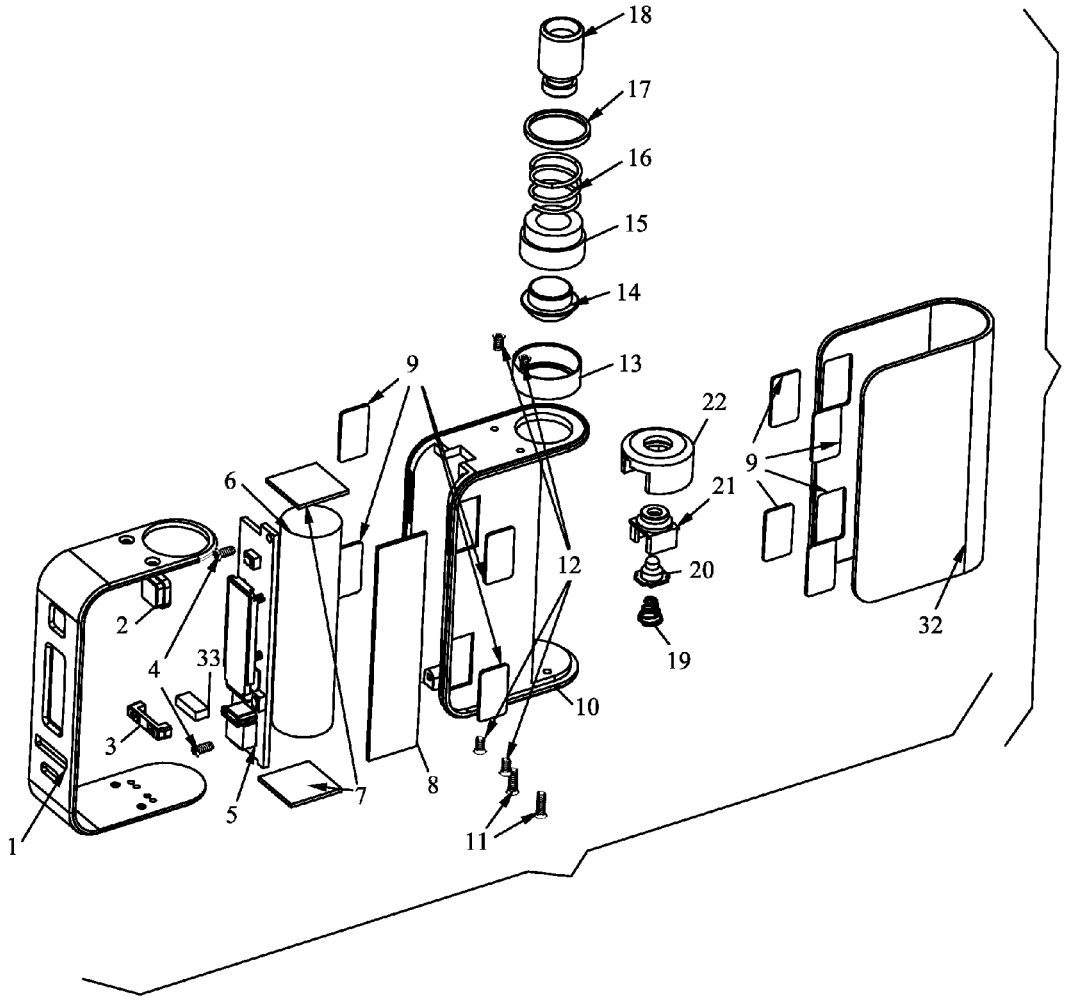
FIG. 2B is an exploded view of a battery assembly of an electronic cigarette in accordance with one embodiment of the invention.
Figure 3:
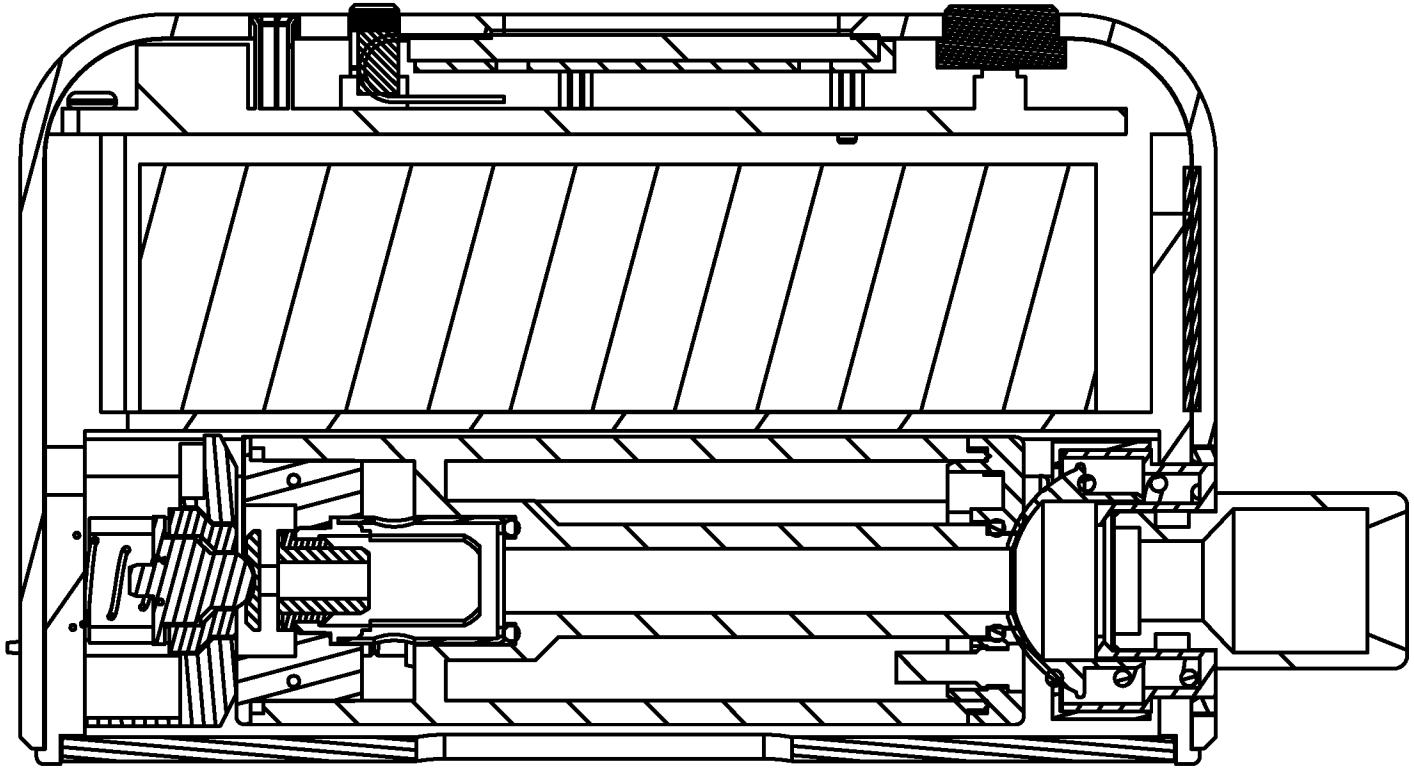
FIG. 3 is a cross-sectional view of an electronic cigarette in accordance with one embodiment of the invention.
Figure 4:
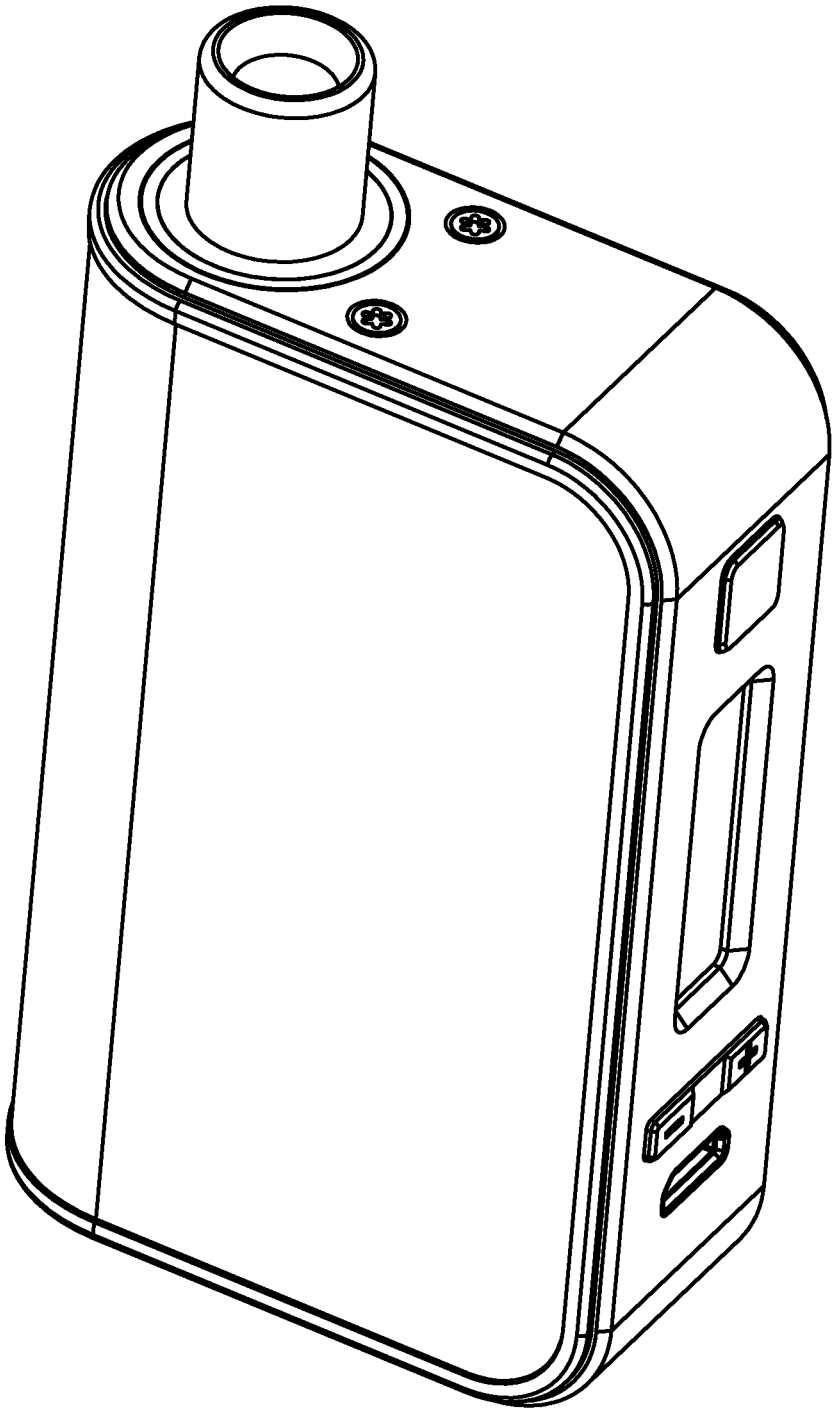
FIG. 4 is a schematic diagram of an electronic cigarette in accordance with one embodiment of the invention.

As shown in FIGS. 1-4, an electronic cigarette comprises an atomizer assembly and a battery assembly. The atomizer assembly is disposed at the right side in the battery assembly, and the atomizer assembly is fastened in the battery assembly. The atomizer assembly comprises two silicon plugs 28. The silicon plugs are inserted through two holes on the shell 27 to the base 25. The two silicon plugs 28 are adapted to seal the flavored liquid in the shell, and seal the flavored liquid from an atomizing core before use. When in use, one end of a traction bar of the silicon plugs 28 which is exposed outside of the base 25 is pulled, and the flavored liquid is allowed to pass through the holes on the shell 27 to the atomizing core, meanwhile, the silicon plugs seals up holes on the base 25, in case the flavored liquid leaks out. The traction bar is broken afterwards, and the silicon plugs remain to seal up the holes on the base 25, and prevent the flavored liquid leakage. When the flavored liquid is added to the shell, the sealing plug 31 is adapted to seals the flavored liquid in the shell. The sealing plug can be demounted only by using tools, or the sealing plug can be used once. And the atomizing core is effectively protected. Two first sealing rings 29 are disposed in the shell 27, and an upper cover 30 is welded on the shell 27 using ultrasonic wave. The sealing plug 31 is disposed on the upper cover 30. The sealing plug 31 can be demounted only by using tools. A heating wire 36 is vertically disposed on a support base 35 of the heating wire. The heating wire is sheathed in a first piece of cotton 37. An insulating ring 24 is mounted on the support base 35, and a connector 23 is mounted on the support base. A limit cover 34 of the heating wire and one of the first sealing rings 29 are disposed on the support base 35. The atomizer assembly further comprises a second sealing ring 26. The second sealing ring is disposed on the base 25. The base 25 is fixedly connected to the shell 27. The above parts are integrated to an atomizer of the electronic cigarette.

Preferably, the electronic cigarette comprises a battery assembly. The battery assembly comprises a plurality of magnets 9. The magnets are embedded in slots on the main carrier 10 and on a housing 32, so that the housing and the main carrier are combined under the effect of magnetic attraction. A first spring 16 is disposed on a first fixing base 15. An atomizer cover 14 is fastened by a first tightening ring 13. The atomizer cover is disposed on the main carrier 10 and is fastened by a second tightening ring 17. A mouthpiece 18 is disposed on the main carrier. The spring 16 is elastic, thus facilitating the assembly and disassembly of atomizer assembly. A positive lead on a PCB board 5 is soldered to an anode on a battery cell 6, and a negative lead on the PCB board is soldered to a cathode on the battery cell. A first piece of EVA cotton 8 is attached to the battery cell 6. Two second pieces of EVA cotton 7 are attached to the anode and the cathode on two sides of the battery cell 6, respectively, so as to avoid short circuit of the electronic cigarette. The PCB board 5 is fixed on the main carrier via a first screw 4. The negative lead is soldered on a second fixing base 22, and the positive lead is soldered on a positive electrode 20. The second fixing base is integrated with the positive electrode, a second spring 19, and an insulating sheet 21, and is fixed on the main carrier 10 via a second screw 11. The positive lead and the negative lead are soldered on two ends of the PCB board 5, respectively. A fourth piece of EVA cotton 33 is attached to a first button 2 and a second button 3. The first button and the second button are mounted on a panel 1. The panel 1 is embedded and fixed in the main carrier 10 via third screws 12 on two sides of the panel, so that the connection between the panel 1 and the main carrier is reliable. The first button and the second button are convenient to press.

Advantage of the electronic cigarette according to embodiments of the invention is that the flavored liquid in the electronic cigarette is sealed from the atomizing core, and the atomizing core is protected.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising an atomizer assembly, the atomizer assembly comprising:

an upper cover;

a shell comprising two through holes;

a base comprising two blind holes;

a heating wire comprising a limit cover and a support base;

two silicon plugs;

an upper sealing ring;

a lower sealing ring; and a sealing plug;

wherein the shell is disposed between the upper cover and the base;

flavored liquid is filled in the shell, and the two silicon plugs are disposed in the two through holes of the shell and seal the two blind holes of the base, respectively;

the two silicon plugs each comprise a breakable neck adapted to be manually broken so that the flavored liquid comes into contact with the heating wire;

the upper sealing ring is disposed between the upper cover and the shell, and the lower sealing ring is disposed between the shell and the limit cover of the heating wire;

the heating wire is vertically disposed on the support base; and the upper cover is welded on the shell; the sealing plug is disposed on the upper cover; the sealing plug is adapted to seal the flavored liquid in the shell.

2. The electronic cigarette of claim 1, wherein the heating wire is sheathed in a first piece of cotton; an insulating ring and a connector are mounted on the support base; and the limit cover of the heating wire is disposed on the support base.

3. The electronic cigarette of claim 1, wherein the atomizer assembly further comprises a second sealing ring; the second sealing ring is disposed on the base; the base is fixedly connected to the shell.

4. The electronic cigarette of claim 1, wherein the electronic cigarette further comprises a battery assembly; the atomizer assembly is disposed at one side in the battery assembly, and the atomizer assembly is fastened in the battery assembly.

5. The electronic cigarette of claim 1, wherein the electronic cigarette further comprises a battery assembly comprising a plurality of magnets, a housing, and a main carrier; the magnets are embedded in slots on the shell and on the main carrier.

6. The electronic cigarette of claim 4, wherein a first spring is disposed on a first fixing base; an atomizer cover is fastened by a first tightening ring; the atomizer cover is disposed on a main carrier and is fastened by a second tightening ring; and a mouthpiece is disposed on the main carrier.

7. The electronic cigarette of claim 5, wherein a first spring is disposed on a first fixing base; an atomizer cover is fastened by a first tightening ring; the atomizer cover is disposed on the main carrier and is fastened by a second tightening ring; and a mouthpiece is disposed on the main carrier.

8. The electronic cigarette of claim 1, wherein a positive lead on a PCB board is soldered to an anode on a battery cell, and a negative lead on the PCB board is soldered to a cathode on the battery cell; a first piece of ethylene-vinyl acetate copolymer (EVA) cotton is attached to a battery cell; and a second piece of EVA cotton and a third piece of EVA cotton are attached to the anode and the cathode on two sides of the battery cell, respectively.

9. The electronic cigarette of claim 8, wherein the PCB board is fixed on the main carrier via a first screw; the negative lead is soldered on a second fixing base, and the positive lead is soldered on a positive electrode; the second fixing base is integrated with the positive electrode, a second spring, and an insulating sheet, and is fixed on the main carrier via a second screw; the positive lead and the negative lead are soldered on two ends of the PCB board, respectively; a fourth piece of EVA cotton is attached to a first button and a second button; the first button and the second button are mounted on a panel; the panel is embedded and fixed in the main carrier via third screws on two sides of the panel.

* * * * *